US008794308B1

(12) United States Patent
Milanovich

(10) Patent No.: US 8,794,308 B1
(45) Date of Patent: Aug. 5, 2014

(54) BLOWOUT PREVENTER AND FLOW REGULATOR

(71) Applicant: Philip John Milanovich, Phoenix, AZ (US)

(72) Inventor: Philip John Milanovich, Phoenix, AZ (US)

(73) Assignee: Milanovich Investments, L.L.C., Phoenix, AZ (US)

( * ) Notice: Subject to any disclaimer, the term of this patent is extended or adjusted under 35 U.S.C. 154(b) by 0 days.

(21) Appl. No.: 13/947,084

(22) Filed: Jul. 21, 2013

(51) Int. Cl.
*E21B 33/06* (2006.01)

(52) U.S. Cl.
CPC ..... *E21B 33/062* (2013.01)
USPC ..... 166/85.4; 166/335; 166/343; 166/361; 166/364; 166/379; 405/52

(58) Field of Classification Search
CPC ..... E21B 33/06; E21B 33/061; E21B 33/062; E21B 34/02
USPC ..... 166/368, 381, 386, 63, 75.11, 86.1, 166/97.1, 316, 332.1
See application file for complete search history.

(56) References Cited

U.S. PATENT DOCUMENTS

| | | | | |
|---|---|---|---|---|
| 1,543,456 | A | 6/1925 | Stirling | |
| 3,548,848 | A | 12/1970 | Stichling | |
| 3,766,979 | A * | 10/1973 | Petrick | 166/55 |
| 3,980,094 | A | 9/1976 | Schroeder et al. | |
| 4,215,749 | A | 8/1980 | Dare et al. | |
| 4,323,117 | A * | 4/1982 | Pierce | 166/55 |
| 4,523,639 | A | 6/1985 | Howard, Jr. | |
| 4,619,284 | A | 10/1986 | Delarue et al. | |
| 5,012,854 | A | 5/1991 | Bond | |
| 5,064,164 | A | 11/1991 | Le | |
| 5,156,212 | A * | 10/1992 | Bryant | 166/298 |
| 5,735,502 | A | 4/1998 | Levett et al. | |
| 6,125,928 | A * | 10/2000 | Ninivaara et al. | 166/55 |
| 6,244,560 | B1 * | 6/2001 | Johnson | 251/1.3 |
| 6,354,568 | B1 | 3/2002 | Carruthers | |
| 6,739,570 | B2 | 5/2004 | Carlsen | |

(Continued)

FOREIGN PATENT DOCUMENTS

| | | |
|---|---|---|
| CA | 2 506 828 A1 | 10/2006 |
| GB | 2 175 328 A | 11/1986 |
| SU | 1427057 A1 | 9/1988 |

*Primary Examiner* — Jennifer H Gay
*Assistant Examiner* — Elizabeth Gitlin
(74) *Attorney, Agent, or Firm* — Swift & Swift; Stephen Christopher Swift

(57) ABSTRACT

A blowout preventer and flow regulator, comprising blocks, each having a channel and plates to close it. The blocks are placed over a pipe through which oil or other fluid is escaping, so that the pipe is in their channels. Alongside the channel in each block are one or more plates, having diameters somewhat larger than the diameter of the channel. One or more pistons are attached to each of the plates. Explosive charges, or other suitable means, move the pistons to propel the plates across the channel to seal it off and stop the leak. Flanges may limit the pistons' movement. Gears can engage teeth on the pistons to withdraw the plates from the channel, to reopen it and allow the flow of oil or other fluid to resume. Plates may be withdrawn part way from the channel, to reduce and control the flow, without cutting it off completely.

17 Claims, 21 Drawing Sheets

(56) References Cited

U.S. PATENT DOCUMENTS

| | | | | |
|---|---|---|---|---|
| 7,243,713 | B2 | 7/2007 | Isaacks et al. | |
| 7,367,396 | B2 * | 5/2008 | Springett et al. | 166/298 |
| 7,814,979 | B2 * | 10/2010 | Springett et al. | 166/298 |
| 8,066,070 | B2 * | 11/2011 | Springett et al. | 166/298 |
| 8,316,872 | B1 | 11/2012 | Milanovich | |
| 2007/0246215 | A1 * | 10/2007 | Springett et al. | 166/298 |
| 2008/0286534 | A1 * | 11/2008 | Springett et al. | 428/192 |
| 2009/0050828 | A1 | 2/2009 | Edwards | |

* cited by examiner

BLOWOUT PREVENTER AND FLOW REGULATOR

BACKGROUND OF THE INVENTION

1. Field of the Invention

The present invention relates to apparatus and methods for preventing, regulating or stopping the escape of oil, gas or other fluid from wells or pipes.

2. Description of the Prior Art

As shown by recent events in the Gulf of Mexico, oil well blowouts are a serious threat to the environment, and can be very costly. Current blowout control devices can be unreliable. While there are numerous prior inventions of blowout control devices, none are equivalent to the present invention.

U.S. Pat. No. 1,543,456, issued on Jun. 23, 1925, to Robert Stirling, discloses an early blowout preventer, without the explosive charges or pistons of the instant invention.

U.S. Pat. No. 3,548,848, issued on Dec. 22, 1970, to Gerhardt C. Stichling, discloses explosive actuated valves, but does not disclose their use in a blowout control device, as in the instant invention.

U.S. Pat. No. 3,766,979, issued on Oct. 23, 1973, to John T. Petrick, discloses a well casing cutter and sealer, but does not disclose pistons moving the plates, as in the instant invention.

U.S. Pat. No. 3,980,094, issued on Sep. 14, 1976, to Fritz Schröder and Klaus Rössel, discloses a quick action slide valve with a sliding plate, but does not disclose the pistons moving the plates of the instant invention.

U.S. Pat. No. 4,215,749, issued on Aug. 5, 1980, to Roy R. Dare and Jeff L. Merten, discloses a gate valve for shearing workover lines to permit shutting a well, using a shear plate and pistons. The instant invention is distinguishable, in that in it the plates are explosively activated and/or retractable by gears.

U.S. Pat. No. 4,523,639, issued on Jun. 18, 1985, to Roland M. Howard, Jr., discloses ram-type blowout preventers, with a piston and a locking mechanism to hold the plate in the channel after the pipe has been cut, but does not disclose a flange to limit motion of the piston, as in the instant invention.

U.S. Pat. No. 4,619,284, issued on Oct. 28, 1986, to Jean-Jacques Delarue and Claude Ego, discloses a pyrotechnic valve that may either close an initially open pipe or open an initially closed pipe, but does not disclose its use in a blowout control device, as in the instant invention.

U.S. Pat. No. 5,012,854, issued on May 7, 1991, to John A. Bond, discloses a pressure release valve for a subsea blowout preventer that is hydraulically operated. The instant invention is distinguishable, in that in it the plates are explosively activated and/or retractable by gears.

U.S. Pat. No. 5,064,164, issued on Nov. 12, 1991, to Tri C. Le, discloses a blowout preventer with metal inserts resembling the plates in the instant invention, but does not disclose explosive actuation or movement of the plates by gears, as in the instant invention.

U.S. Pat. No. 5,156,212, issued on Oct. 20, 1992, to Thomas B. Bryant, discloses a method and system for controlling high pressure flow, such as in containment of oil and gas well fires, but does not disclose pistons whose movement is limited by flanges, as in the instant invention.

U.S. Pat. No. 5,735,502, issued on Apr. 7, 1998, to Bryce A. Levett and Mike C. Nicholson, discloses a blowout preventer with ram blocks resembling the plates in the instant invention, and is hydraulically actuated. The instant invention is distinguishable in that it has pistons whose movement is limited by flanges.

U.S. Pat. No. 6,354,568, issued on Mar. 12, 2002, to Alec Carruthers, discloses a sliding plate valve, but does not disclose pistons whose movement is limited by flanges, as in the instant invention.

U.S. Pat. No. 6,739,570, issued on May 25, 2004, to Hans-Paul Carlsen, discloses a valve element, which may be used for closing a channel in a blowout preventer, but does not disclose pistons whose movement is limited by flanges, as in the instant invention.

U.S. Pat. No. 7,243,713, issued on Jul. 17, 2007, to C. Steven Isaacks, discloses a shear/seal assembly for a ram-type blowout prevention system. The instant invention is distinguishable, in that it discloses plates that are explosively activated and/or retractable by gears.

U.S. Pat. No. 8,316,872, issued on Nov. 27, 2012, and pending U.S. patent application Ser. No. 13/685,957, filed on Nov. 27, 2012, both to Philip John Milanovich, the inventor and applicant herein, disclose blowout preventers using plates propelled by explosive charges. The instant invention is distinguishable, in that in it the plates are moved by pistons, whose movement is limited by flanges.

U.S. Patent Application Publication No 2009/0050828, published on Feb. 26, 2009, to Jeffrey Charles Edwards, discloses blowout preventers with a housing having a throughbore resembling the channel in the instant invention, which may be closed by a pair of opposed rams, but does not disclose limitation of movement by flanges, explosive actuation, or movement by gears, as in the instant invention.

British Patent No. 2 175 328, published on Nov. 26, 1986, to Richard Theodore Mitchell, discloses an oil well drilling apparatus, including a blowout preventer stack, without the use of explosive charges, or movement of the plates by pistons moved by gears, as in the instant invention.

Canadian Patent No. 2 506 828, published on Oct. 29, 2006, inventors Dean Foote and Scott Delbridge, discloses a blowout preventer with rams that are hydraulically rather than explosively actuated, or moved by pistons moved by gears, as in the instant invention.

Soviet Patent No. 1427057, published Sep. 30, 1988, inventors Y. U. A. Gavrilin, L. M. Torsunov and B. V. Venedictov, discloses a blowout preventer with a flat blocking gate.

None of the above inventions and patents, taken either singly or in combination, is seen to describe the instant invention as claimed.

SUMMARY OF THE INVENTION

U.S. Pat. No. 8,316,872, issued on Nov. 27, 2012, and pending U.S. patent application Ser. No. 13/685,957, filed on Nov. 27, 2012 as a continuation-in-part, both to Philip John Milanovich, the inventor and applicant herein, disclosed the following, which are the first and second preferred embodiments in the Detailed Description of the Preferred Embodiments below, and are shown in FIGS. 1-11: A blowout preventer including one or more blocks (made of metal, concrete or other suitable material), having a cylindrical channel. The blocks can be placed over (or onto) a well pipe or other pipe through which oil (or gas or other fluid) is flowing, so that the pipe is in the metal or concrete block, or at an end of the cylindrical channel. The oil will initially flow through the channel. Alongside the channel are one or more circular plates, having diameters somewhat larger than the diameter of the channel. Explosive charges propel the plates into the channel to seal it off and stop the oil leak. The explosive charges may be ignited by a radio, electric or sonic signal or other suitable means. There are passages for the plates that are at right angles to the cylindrical channel, that allow the plates to move into place to block the channel, while preventing them from moving too far and passing by the channel. Rachets or plate reversal stops keep the plates from moving back after they have blocked the channel. Vents allow gas from the explosive charges to escape. The plates may be grooved and/or tunneled, and the end of the passage (or female receptive) that stops the plate may be grooved. The plates should be thick enough to stop the flow of oil, but not so thick that the well cannot be later reopened by drilling through the plates.

The present application is being filed as a new application, without any claim of priority from the above-mentioned issued patent and pending patent application. The following are the new features in the present application, which are believed make its subject matter patentably distinct, that are the third preferred embodiment in the Detailed Description of the Preferred Embodiments below, and are shown in FIGS. 12-21:

1. One or more pistons are attached to each of the plates. The explosive charges, or other means of movement, move the pistons, which move the plates. There is a passage in the blocks for each of the pistons, the passage having a narrow portion adjacent to the channel and a wide portion away from the channel. A flange on each piston on an end of the piston opposite the plate to which it is attached, prevents the end of the piston from moving into the narrow portion of the passage, thus limiting the movement of the plate to which the piston is attached. There may be a plurality of pistons attached to each plate, and varying lengths of the pistons, and/or of the narrow and wide portions of the passages, can cause the plates to move varying distances.

2. Gears having teeth that can engage teeth on the pistons to move the plates out from the channel after the explosive charge has been fired. The plates may be moved out from the channel part way or all the way. The gears may also be an alternative means for moving the plates into the channel, either part way or all the way.

Accordingly, it is a first object of the invention to prevent damage to the environment from oil well blowouts.

It is a second object of the invention to prevent economic loss from oil well blowouts.

It is a third object of the invention to prevent damage to the environment from any kind of fluid escaping from a pipe.

It is a fourth object of the invention is to prevent economic loss from any kind of fluid escaping from a pipe.

It is a fifth object of the invention to create a safer environment for any fluid carrying pipe or pipe-like structure.

It is a sixth object of the invention to provide a control or shutoff mechanism that can be reopened.

It is a seventh object of the invention to provide a control or shutoff mechanism that can be repeatedly opened and shut.

It is an eighth object of the invention to provide an apparatus and method that is compatible with other blowout preventers and flow regulators.

It is a ninth object of the invention to provide a blowout preventer and flow regulator that is manageable in size, weight and configuration.

It is a tenth object of the invention to provide a blowout preventer and flow regulator that can be sized appropriately to its need and usage.

It is an eleventh object of the invention to provide a blowout preventer and flow regulator that can be used initially or retrofitted.

It is a twelfth object of the invention to provide a blowout preventer and flow regulator that has an immediate response time, thus saving lives and investment.

It is a thirteenth object of the invention to provide a blowout preventer and flow regulator that has a shorter activation time than the prior art.

It is a fourteenth object of the invention to provide a blowout preventer and flow regulator using plates, wherein if some plates are defective, they can be drilled through, and it will still be effective because of a multiple plate design.

It is a fifteenth object of the invention to provide a blowout preventer and flow regulator, wherein stacking of plates gives multiple options for control.

It is a sixteenth object of the invention to provide a blowout preventer and flow regulator that is easy to install or replace.

It is a seventeenth object of the invention to provide a means for fitting oil or gas wells with flow regulators to control and/or resume the flow of oil or gas.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention a blowout preventer with one or more explosively actuated plates.

Figure 1:
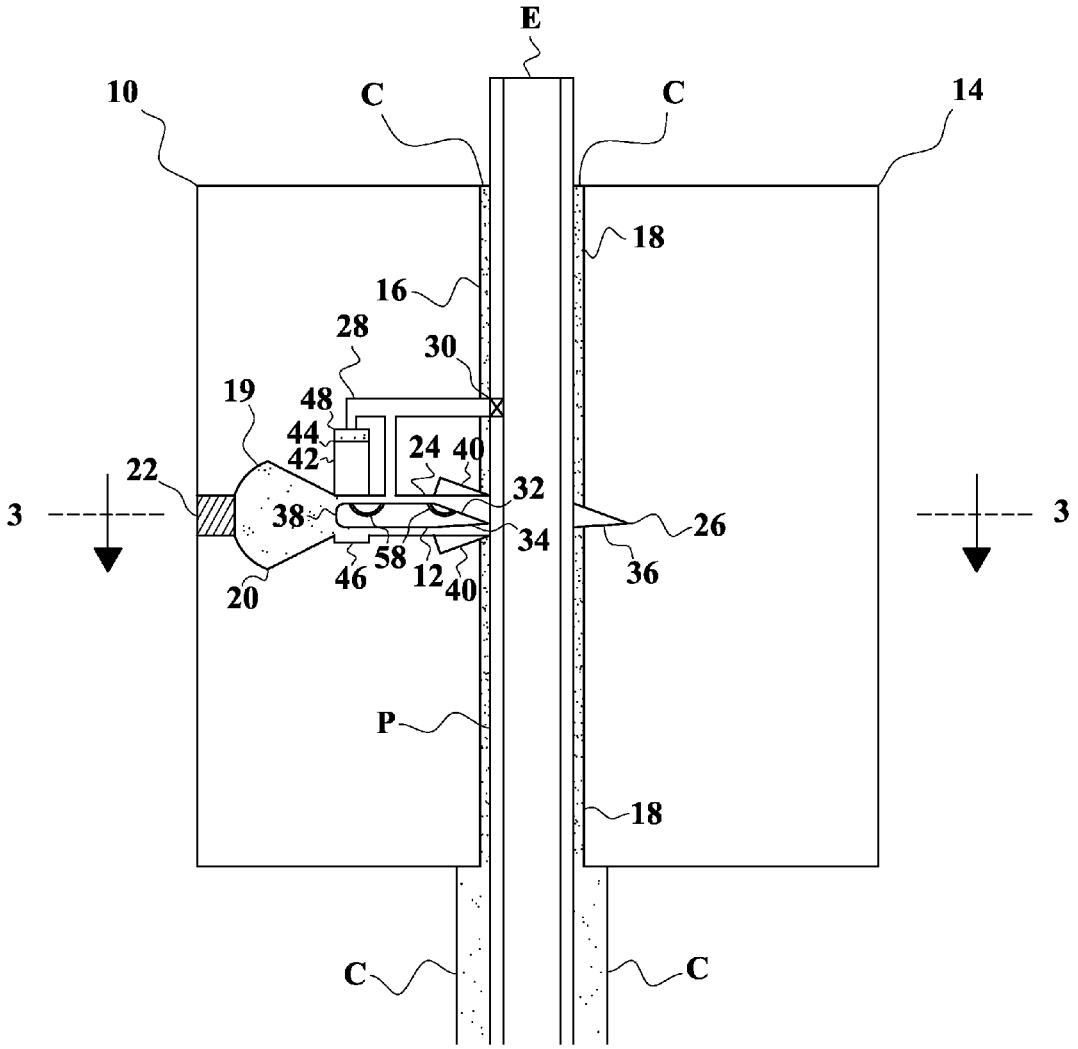
FIG. 1 is a vertical sectional view drawn along lines 1-1 of FIG. 3 of the first preferred embodiment of the invention, showing the position of the plate before the explosive charge has been fired.
Figure 3:
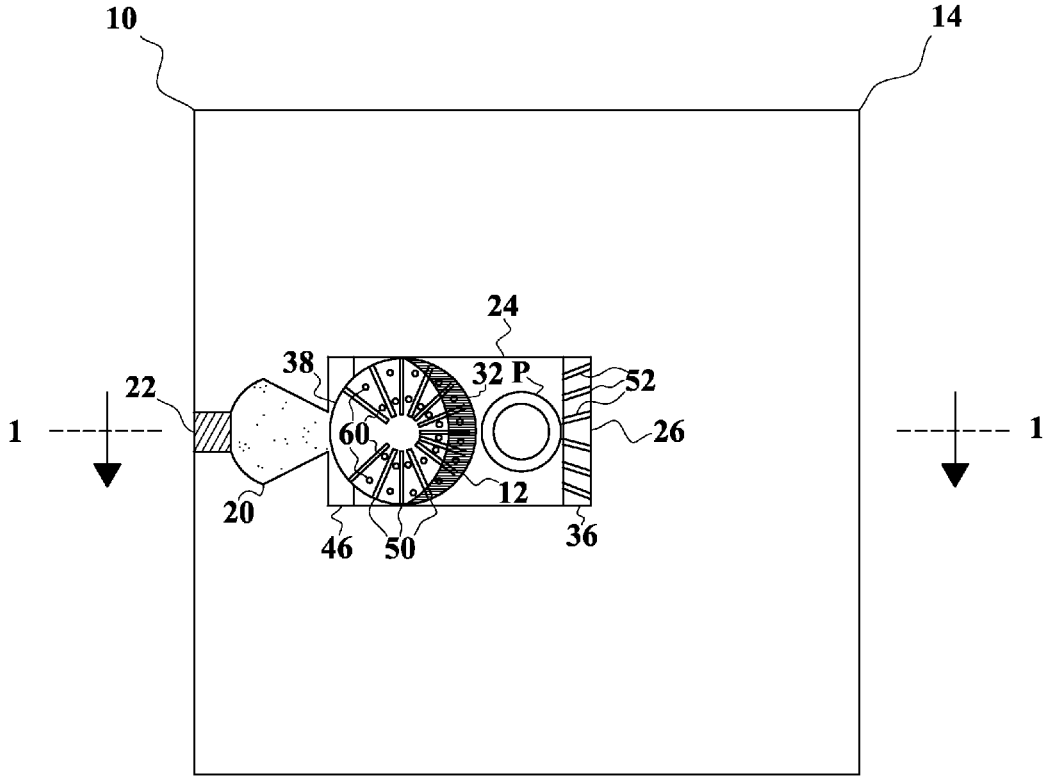
FIG. 3 is a horizontal sectional view drawn along lines 3-3 of FIG. 1 of the first preferred embodiment of the invention, showing the position of the plate before the explosive charge has been fired.

FIG. 1 is a vertical sectional view drawn along lines 1-1 of FIG. 3 of the first preferred embodiment of the invention 10, showing the position of the plate 12 before the explosive charge has been fired. The block 14 has a cylindrical channel 16 with ends 18 configured so that it can be inserted over the open end E of pipe P through which fluid (such as petroleum or natural gas) can escape. (The pipe may be a well pipe or riser, undersea or on land.) An explosive charge 19 in chamber 20 when fired will propel the plate across the channel to block the flow of fluid. A receiver/ignitor 22 when ignite the explosive charge when it receives a radio, electrical, sonic or other signal to do so. When the charge is fired, the plate will move in passage 24 with far end 26. Vents 28 will allow gases from the charge to escape through one-way valves 30 into the pipe above the plate. The upper edge 32 of the side of the plate facing the pipe is inclined so that it can cut through the walls of the pipe, and to enable fluid to escape upward in the pipe. The lower edge 34 of the side of the plate facing the pipe is slightly inclined, and the lower edge 36 of the far end of the passage is also slightly inclined, to insure that the plate can move through the passage and close off the pipe even if the edge of the plate and the far end of the passage become slightly misaligned. The edge 38 of the plate facing the charge is blunt or rounded, so that the plate will be propelled by the charge. Plate reversal steps 40 are above and below the plate before the charge is fired. A back flow preventer 42 is above the plate before the charge is fired, in the back flow preventer passage 44 with lower end 46 below the plate. There is a back flow preventer charge 48 in the back flow preventer passage above the back flow preventer before the charge 19 is fired. When the block is placed over and around the pipe, cement C is placed over the pipe and the side of the block into which the pipe is inserted, and allowed to harden, to create a tight seal and prevent fluids (such as seawater or oil) from leaking in or out. Any other suitable means may be substituted for cement to seal any space between the pipe and channel and retain the block on the pipe. The block is made of metal, concrete, or other suitable material.

Figure 2:
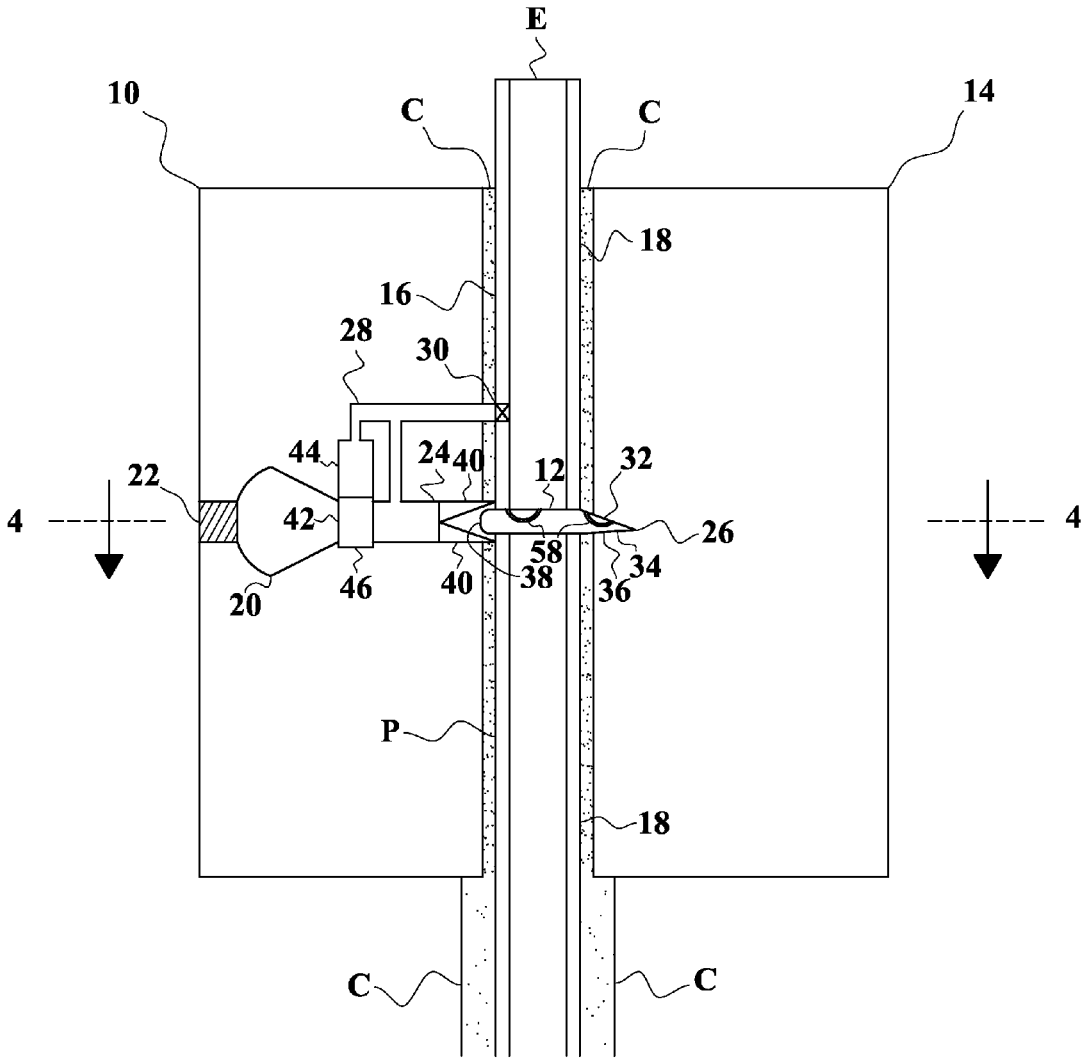
FIG. 2 is a vertical sectional view drawn along tines 2-2 of FIG. 4 of the first preferred embodiment of the invention, showing the position of the plate after the explosive charge has been fired.
Figure 4:
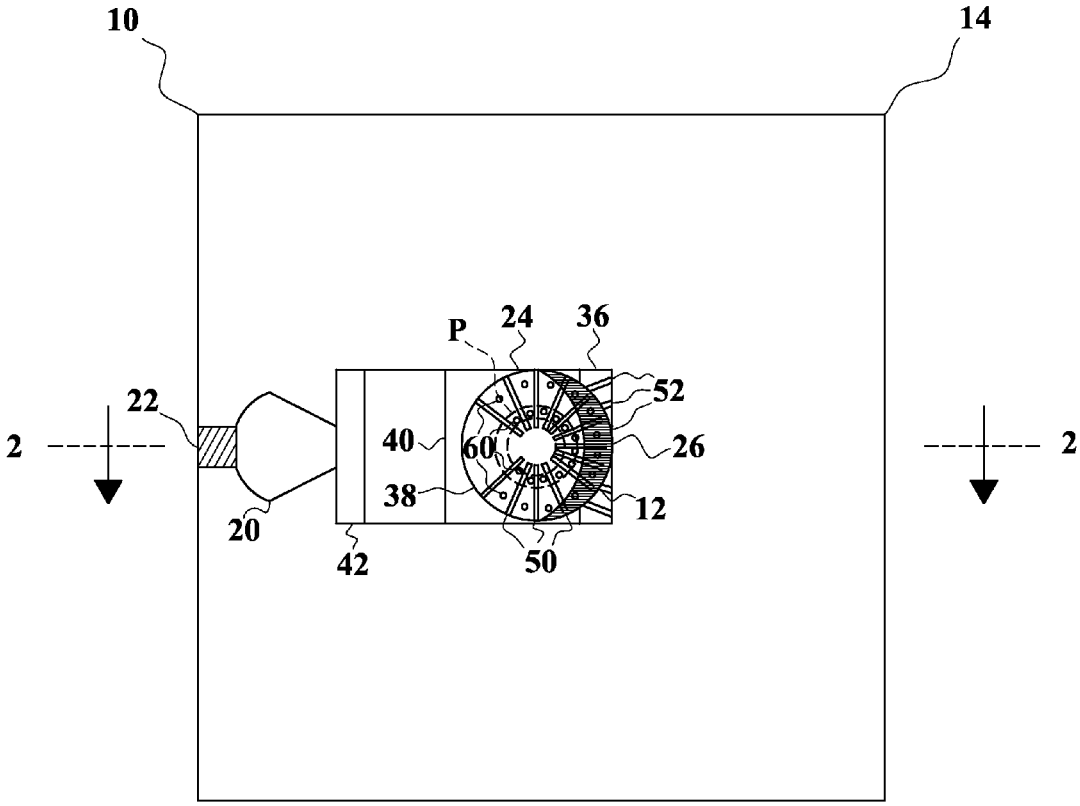
FIG. 4 is a horizontal sectional view drawn along lines 4-4 of FIG. 2 of the first preferred embodiment of the invention, showing the position of the plate after the explosive charge has been fired.

FIG. 2 is a vertical sectional view drawn along lines 2-2 of FIG. 4 of the first preferred embodiment of the invention, showing the position of the plate 12 after the explosive charge has been fired. The far end 26 of the passage 24 prevents the plate from moving too far and bypassing the channel. The inclination of the lower edge 34 of the plate should match the inclination of the lower surface 36 of the far end of the passage, to more effectively prevent the escape of fluid. The upper edge 32 and lower edge 34 of the plate form a knife-like blade that is a male element, while the upper and lower surfaces of the end of the passage form a female element, that matingly engage to create a tight seal that prevents fluid from escaping. The plate reversal stops 40 move into the passage and prevent the plate from moving back, locking it in place. The plate reversal stops may be actuated by springs that are released by a trigger mechanism or motion detector when the plate passes, by a timer after the charge is fired, or by any other suitable means. (Alternatively, other locking mechanisms may be used to keep the plate in place.) The charge above the back flow preventer is fired after the charge in chamber 20, and propels the back flow preventer 42 through its passage 44 until it rests against far end 46, thus sealing the passage behind the plate and preventing fluid from escaping. A locking pin or other suitable mechanism may keep the back flow preventer in place. The charge above the back flow preventer may be fired in response to a trigger mechanism or motion detector when the plate passes, by a timer after the main charge is fired, or by any other suitable means. Gases from the charge ignited above the back flow preventer can escape through vents 28. Tunnels 58 passing through upper portions of the plates enable some of the fluid to escape from near edges of the plates to near the centers of the plates into the pipe, above that plates that are blocking its flow. The bottoms of the plates are solid, with no tunnels.

FIG. 3 is a horizontal sectional view drawn along lines 3-3 of FIG. 1 of the first preferred embodiment of the invention, showing the position of the plate before the explosive charge has been fired. Grooves or channels 50 radiate outward from the center of the upper surface of the plate 12, except on the side of the plate facing the charge. There are also grooves or channels 52 in the far end of the passage. Openings 60 at opposite ends of the tunnels though the upper portion of the disk are also shown.

FIG. 4 is a horizontal sectional view drawn along lines 4-4 of FIG. 2 of the first preferred embodiment of the invention, showing the position of the plate after the explosive charge has been fired. It can be seen that the plate 12 is circular and has a somewhat larger diameter than the cylindrical pipe P, so that it can effectively seal the pipe and stop the flow of fluid. The grooves or channels 50 in the plate enable fluid to escape into the interior of the pipe above the plate as the pipe is cut and blocked off by the plate. The grooves and tunnels prevent fluid in the passage from impeding movement of the plate, to ensure unobstructed closure so that it can cut off the flow in the pipe. The grooves and tunnels do not go all the way to the leading edge of the plate, to ensure a seal with the end of the passage. The plate is preferably made of hardened metal, which is thick and hard enough to cut through the pipe and stop the flow, but thin and soft enough that it can be drilled through to reopen an oil or gas well.

There may be a plurality of plates in a single block. There may be a plurality of blocks used on a single pipe or well. This arrangement may be referred to as a "Christmas tree". This will allow the blowout preventer to be used multiple times to prevent multiple blowouts, as it may not be necessary to fire all of the plates to stop a blowout, and the plates that have been fired may be drilled through to reopen the well, while leaving the unfired plates in their original positions for future use.

Figure 5:
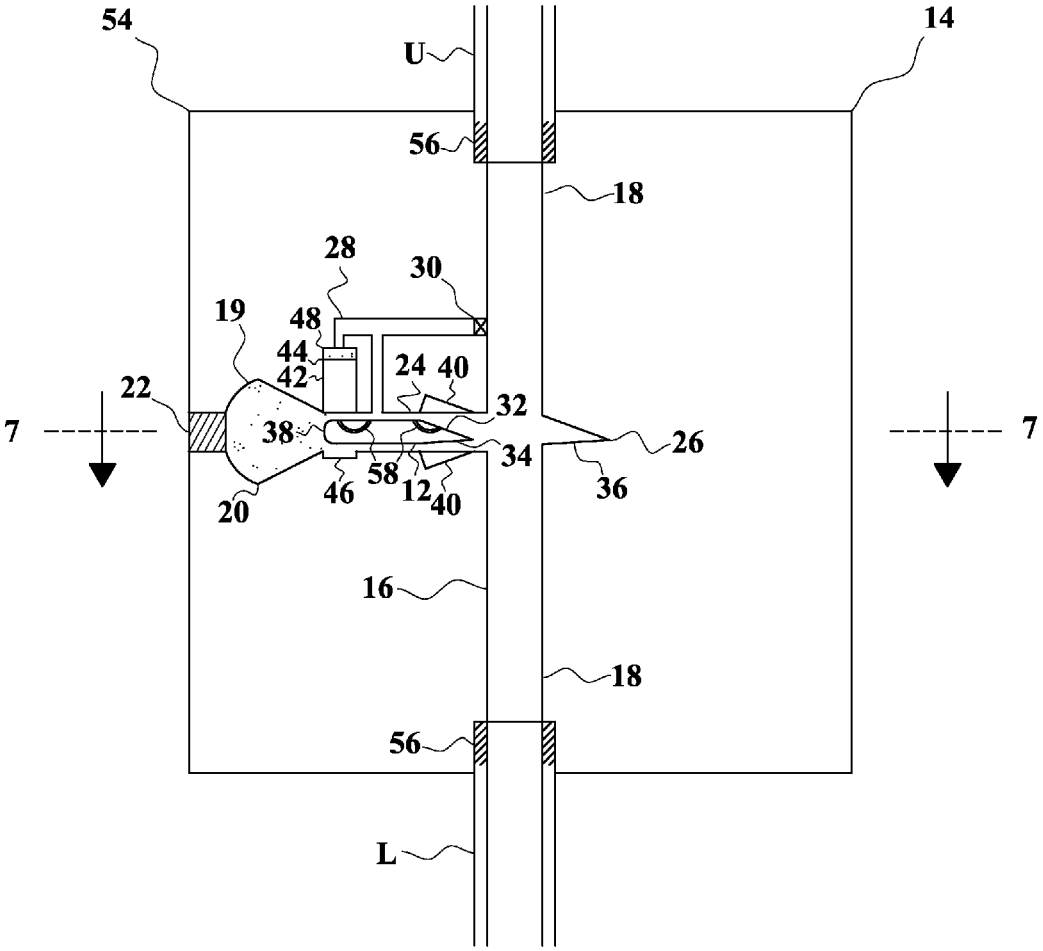
FIG. 5 is a vertical sectional view drawn along lines 5-5 of FIG. 7 of the second preferred embodiment of the invention, showing the position of the plate before the explosive charge has been fired.
Figure 7:
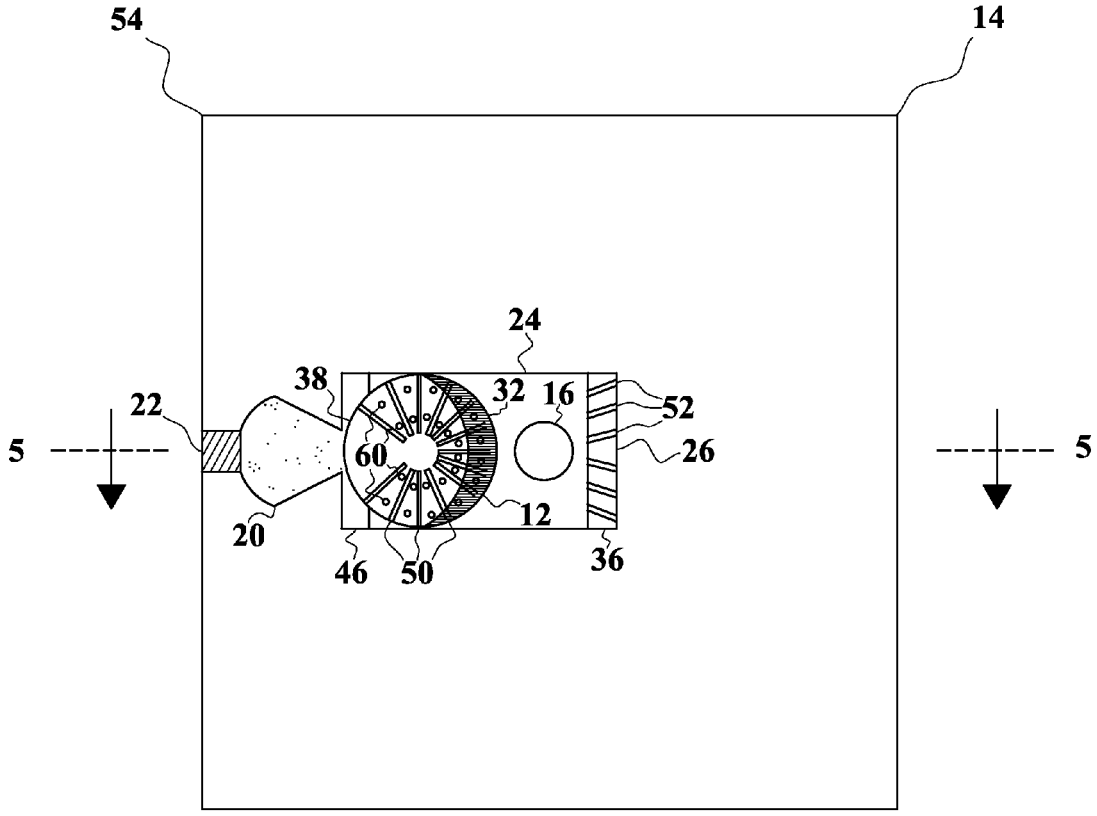
FIG. 7 is a horizontal sectional view drawn along lines 7-7 of FIG. 5 of the second preferred embodiment of the invention, showing the position of the plate before the explosive charge has been fired.

FIG. 5 is a vertical sectional view drawn along lines 5-5 of FIG. 7 of the second preferred embodiment of the invention 54, showing the position of the plate before the explosive charge has been fired. The second preferred embodiment is the same as she first preferred embodiment, except that there is no pipe going through the block, and cement is not used. The block 14 is screwed over the lower pipe L, and the upper pipe U is screwed into the block, using screw threads 56. The fluid flows directly through the channel 16 between the lower pipe and the upper pipe. The lower pipe may be well pipe. The upper pipe may be a riser.

Figure 6:
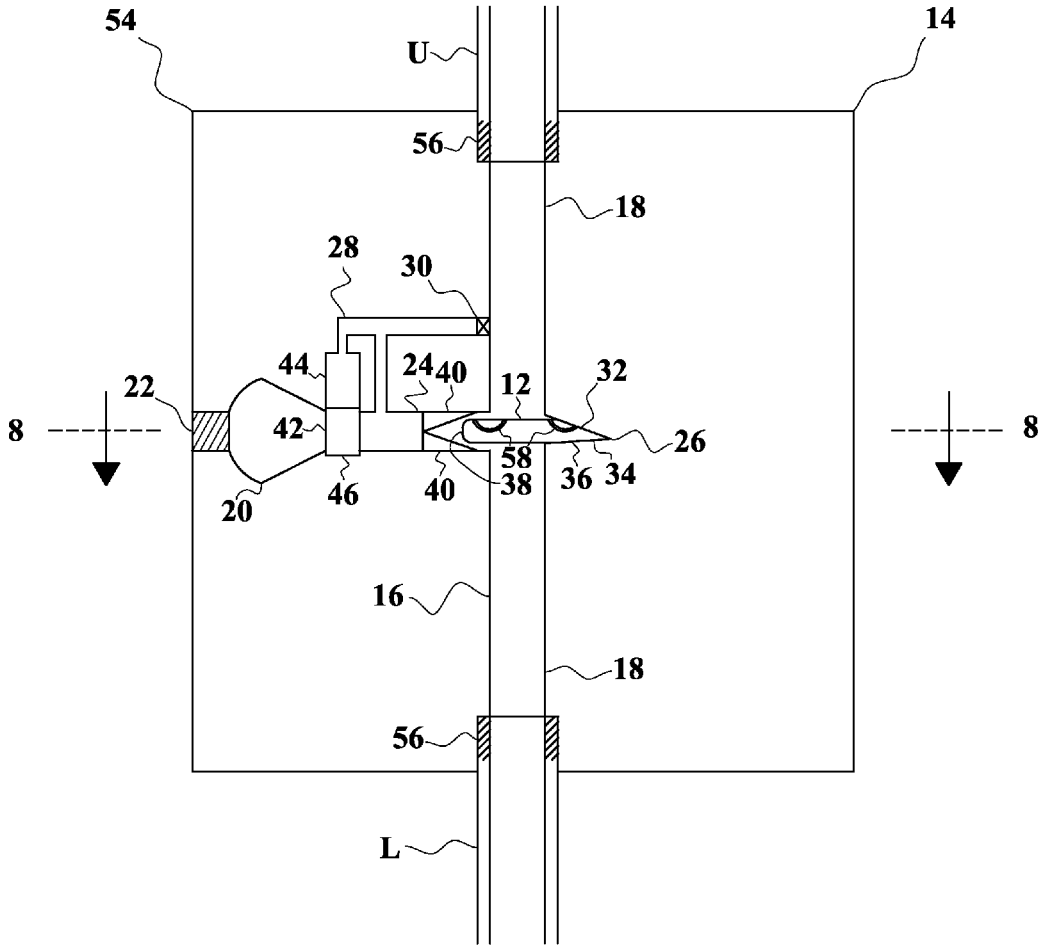
FIG. 6 is a vertical sectional view drawn along lines 6-6 of FIG. 8 of the second preferred embodiment of the invention, showing the position of the plate after the explosive charge has been fired.
Figure 8:
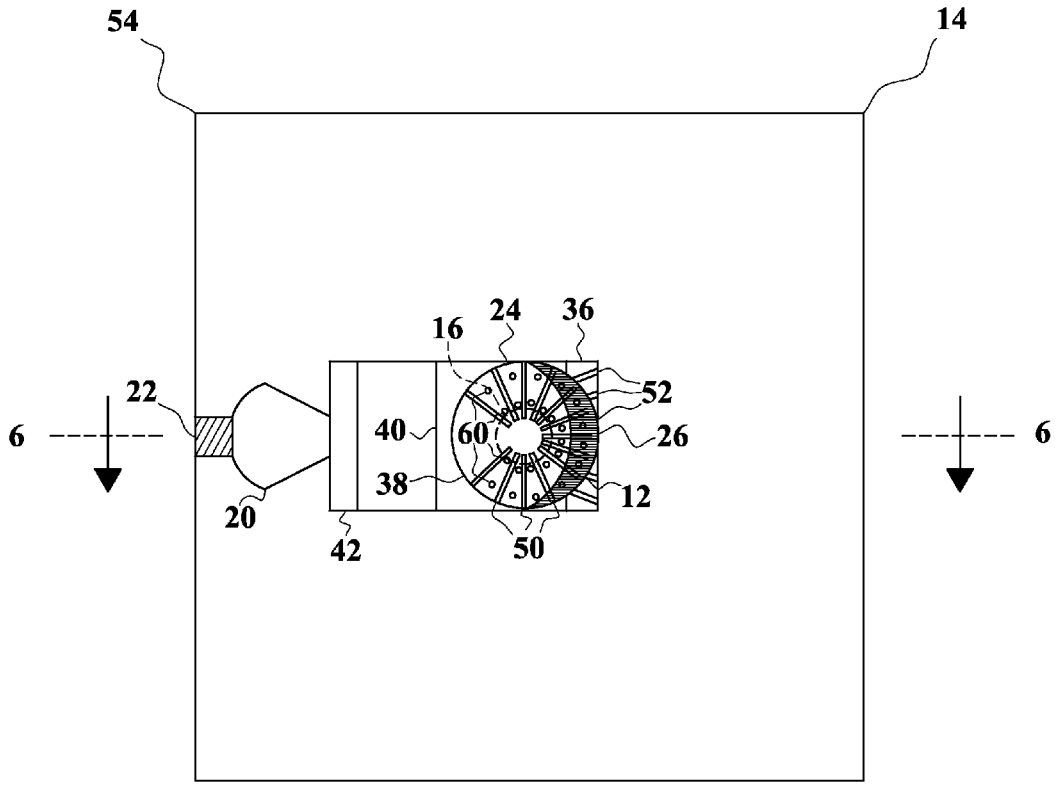
FIG. 8 is a horizontal sectional view drawn along lines 8-8 of FIG. 6 of the second preferred embodiment of the invention, showing the position of the plate after the explosive charge has been fired.

FIG. 6 is a vertical sectional view drawn along lines 6-6 of FIG. 8 of the second preferred embodiment of the invention, showing the position of the plate after the explosive charge has been fired. The plate does not need to cut through a pipe, but blocks the channel directly. As it does not need to cut through the pipe, the plate may be thinner than in the first preferred embodiment, which will make it easier to drill through to reopen the well.

FIG. 7 is a horizontal sectional view drawn along lines 7-7 of FIG. 5 of the second preferred embodiment of the invention, showing the position of the plate before the explosive charge has been fired. FIG. 8 is a horizontal sectional view drawn along lines 8-8 of FIG. 6 of the second preferred embodiment of the invention, showing the position of the plate after the explosive has been fired.

Figure 9:
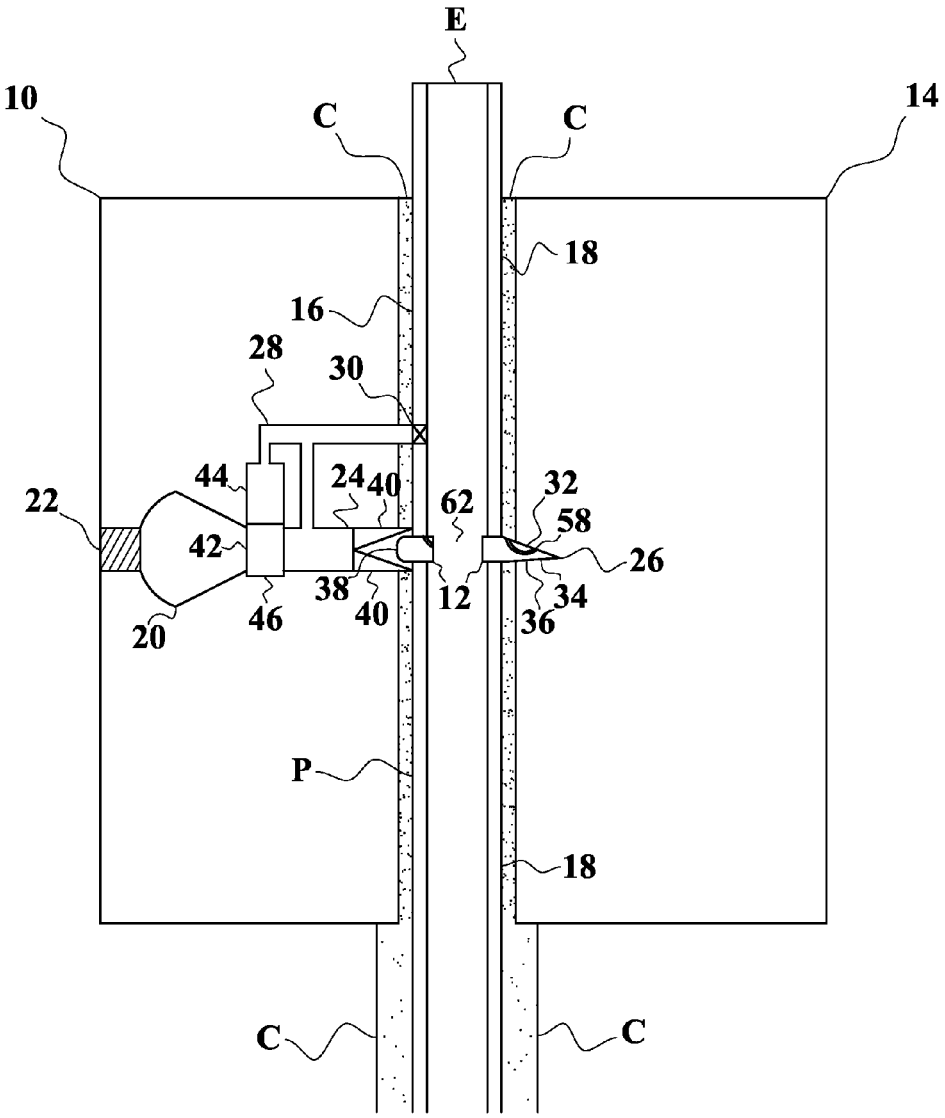
FIG. 9 is a vertical sectional view of the first preferred embodiment of the invention, showing the plate after it has been drilled through to reopen the pipe.
Figure 10:
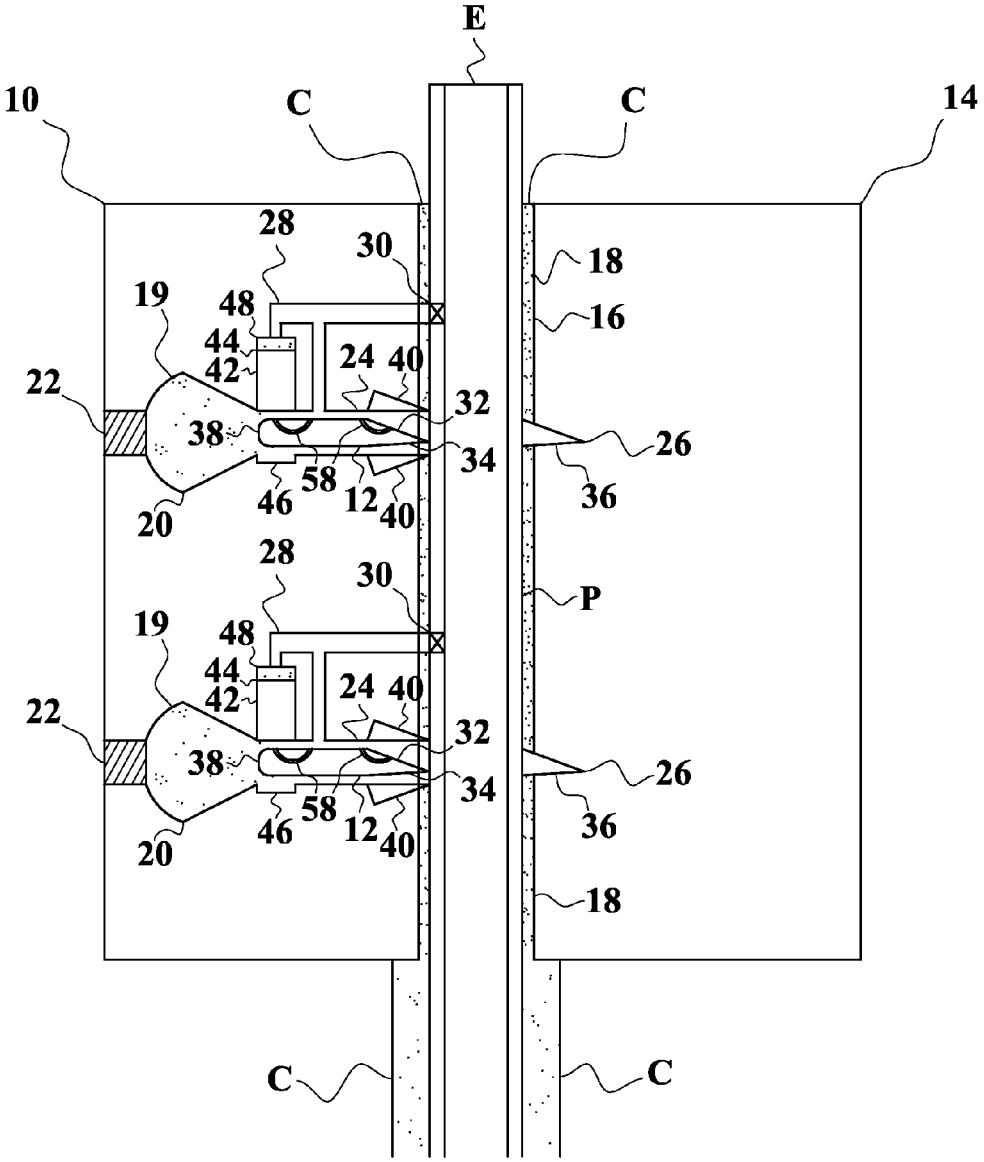
FIG. 10 is a vertical sectional view of the first preferred embodiment of the invention, showing a block with two plates.
Figure 11:
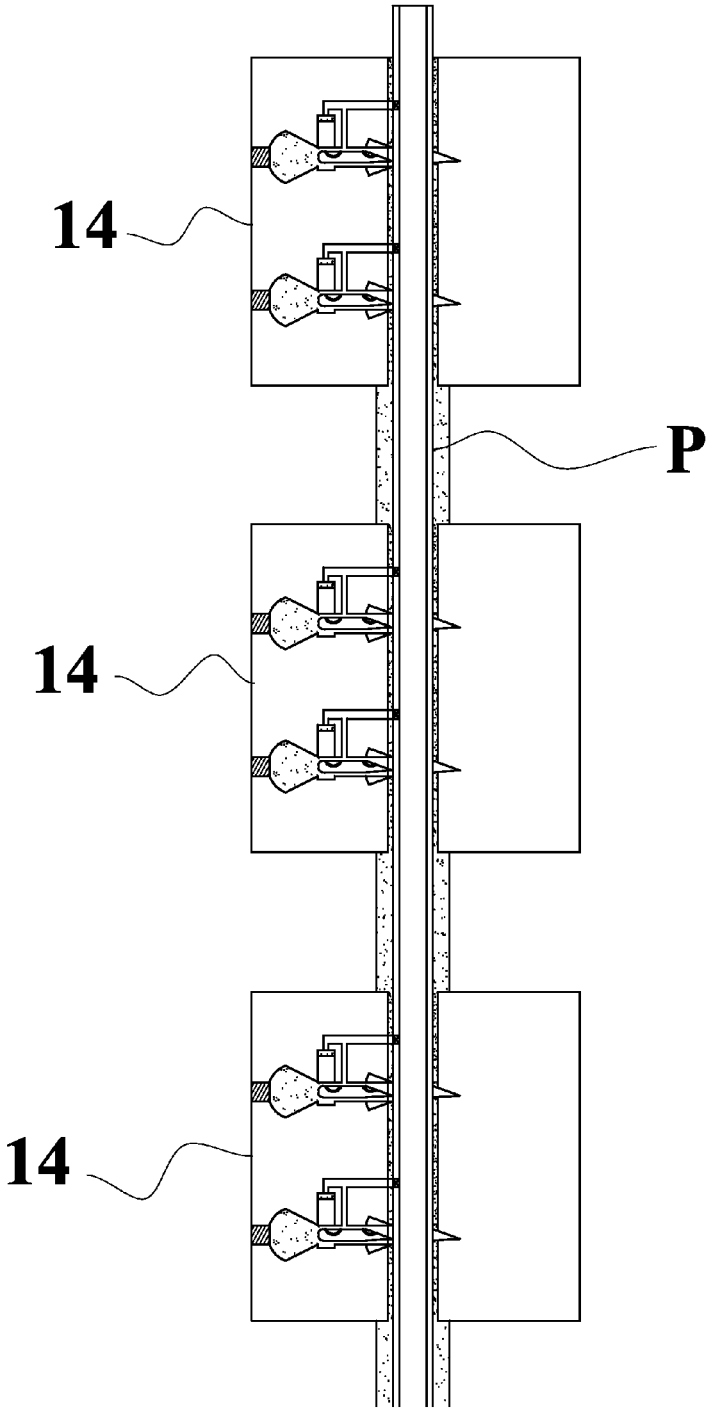
FIG. 11 is a vertical sectional view of the first preferred embodiment of the invention, showing three blocks on a pipe.

FIG. 9 is a vertical sectional view of the first preferred embodiment of the invention, showing the plate after it has been drilled through to reopen the pipe. FIG. 10 is a vertical sectional view of the first preferred embodiment of the invention, showing a block with two plates. FIG. 11 is a vertical sectional view of the first preferred embodiment of the invention, showing three blocks on a pipe. There may be similar arrangements for the second preferred embodiment of the invention.

Figure 12:
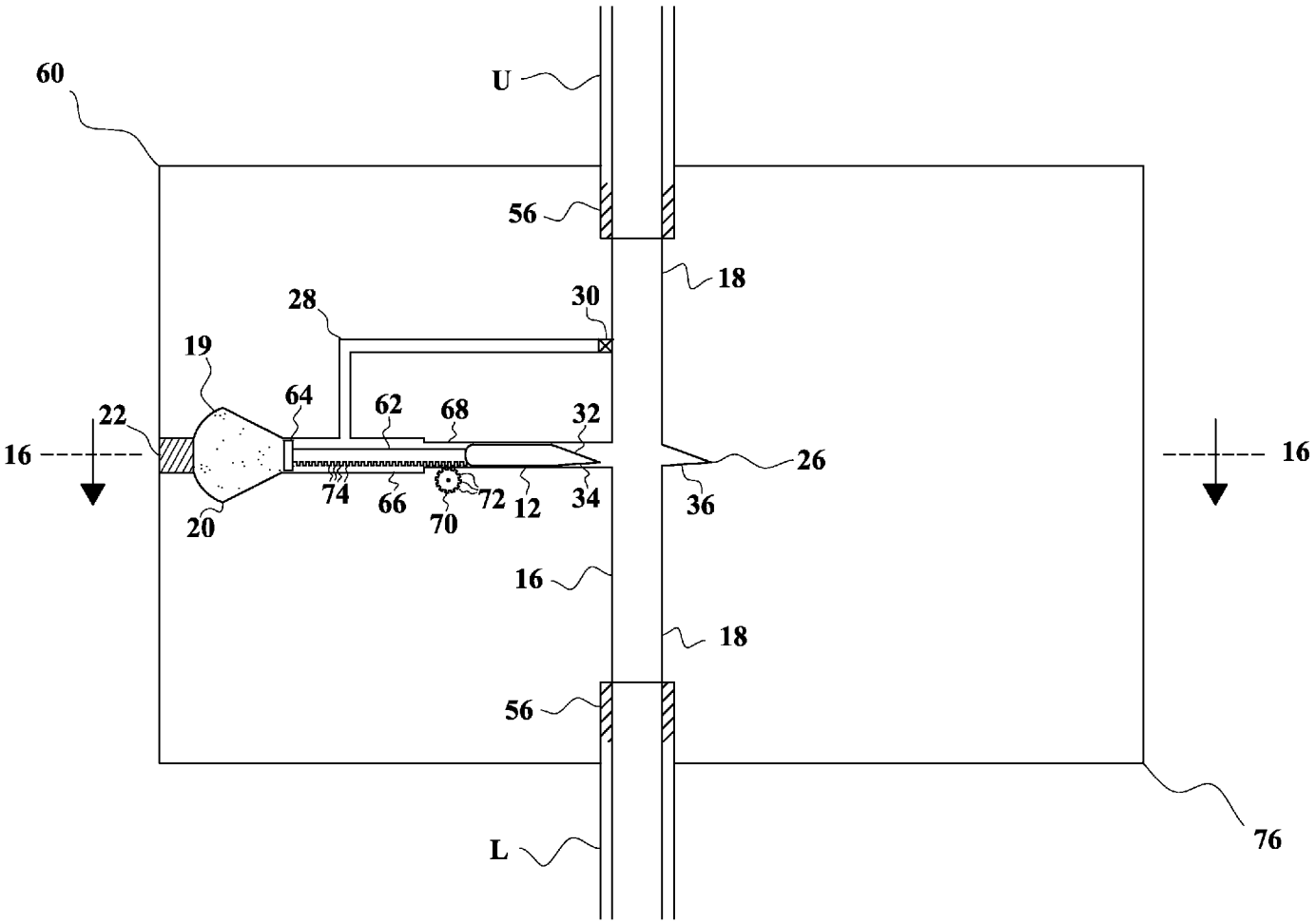
FIG. 12 is a vertical sectional view drawn along lines 12-12 of FIG. 16 of the third preferred embodiment of the invention, showing the position of the plate before any explosive charge has been fired.
Figure 16:
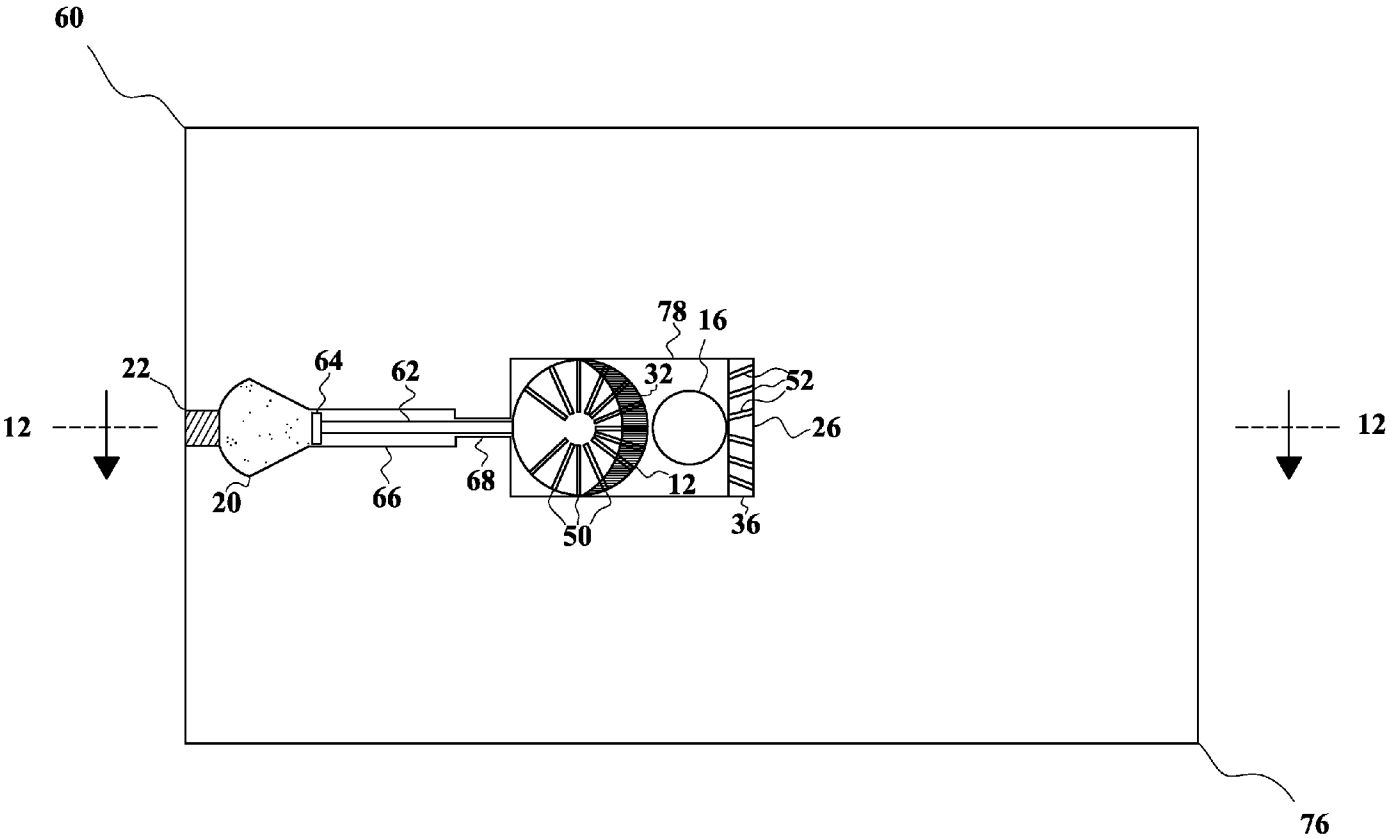
FIG. 16 is a horizontal sectional view drawn along lines 16-16 of FIG. 12 of the third preferred embodiment of the invention, showing the position of the plate before any explosive charge has been fired.

FIG. 12 is a vertical sectional view drawn along lines 12-12 of FIG. 16 of the third preferred embodiment of the invention 60, showing the position of the plate 12 before the explosive charge 19 in the chamber 20 has been fired by the receiver/ignitor 22. The receiver/ignitor may be activated by radio waves, laser, sound, electricity, or any other suitable means. A piston 62 ending in a flange 64 is attached to the plate 12. The piston is propelled by the explosive charge and propels the plate. (Alternatively, the piston and plate may be propelled by hydraulic, pneumatic, mechanical or electrical means, or by any other suitable means.) The piston and plate move in a passage having a wider portion 66 and a narrower portion 68. The flange prevents the end of the piston from moving into the narrow portion of the passage, thus limiting the movement of the plate to which the piston is attached. (As before, the movement of the plate may also be limited by the upper front edge 32 and lower front edge 34 engaging the female element 26, with sloping lower edge 36, on the opposite side of the channel 16.) The gear 70 has teeth 72 that can engage teeth 74 on the underside of the piston, to move the plate completely or partially out from the channel 16. (The gear may also be used as an alternative to the explosive charge, to move the plate completely or partially into the channel. Alternatively, the plates can be drilled through to reopen the channel, as in FIG. 9.) The block 76 is connected to an upper pipe U and a lower pipe L. Oil, gas or other fluid can flow though channel 16. There may be screw threads 56 on the pipes near ends 18 of the channel. As before, gases produced when the explosive charge is ignited can pass through vent 28 and one-way valve 30 into the channel.

Figure 13:
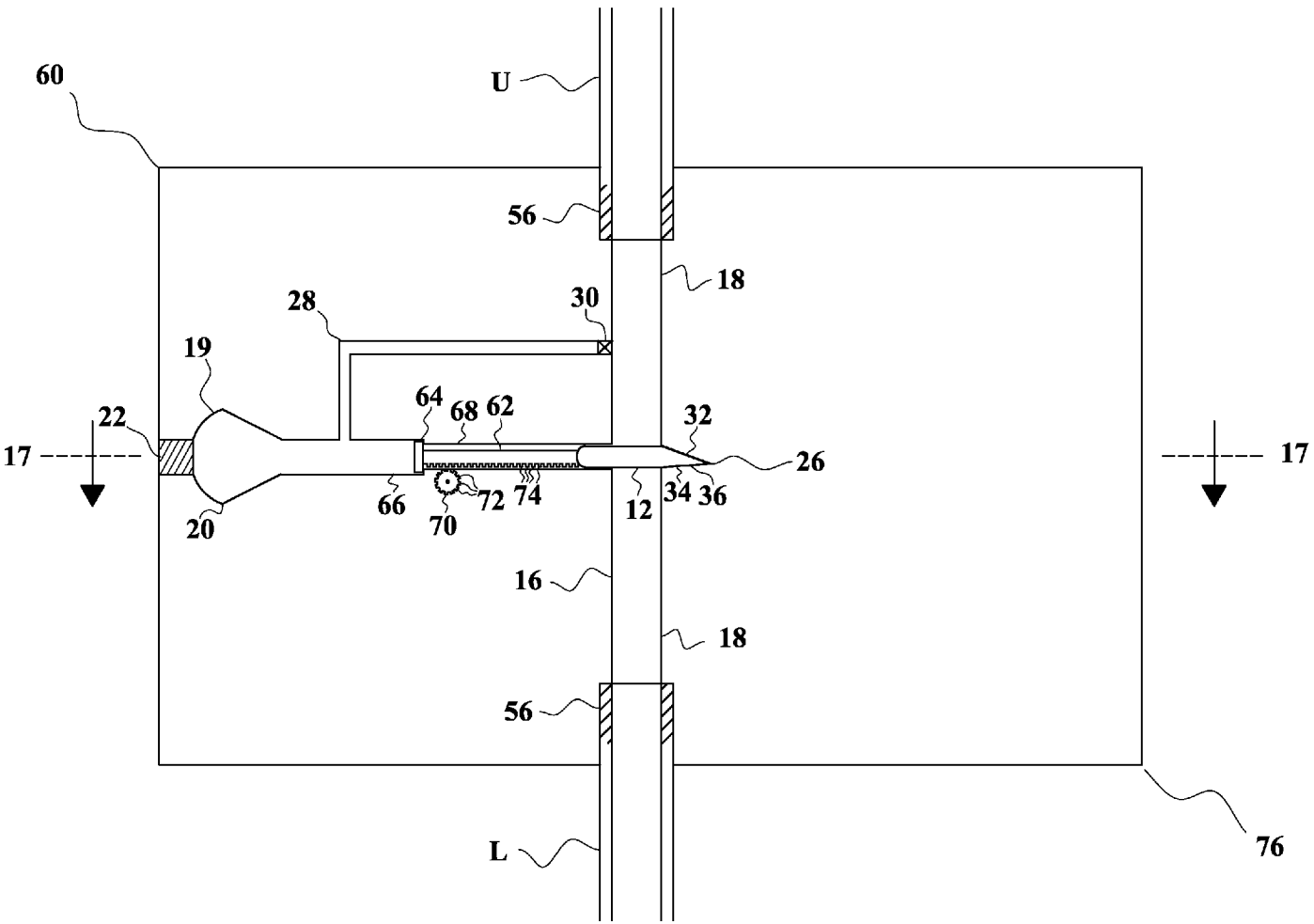
FIG. 13 is a vertical sectional view drawn along lines 13-13 of FIG. 17 of the third preferred embodiment of the invention, showing the position of the plate after the explosive charge for the piston has been fired.
Figure 14:
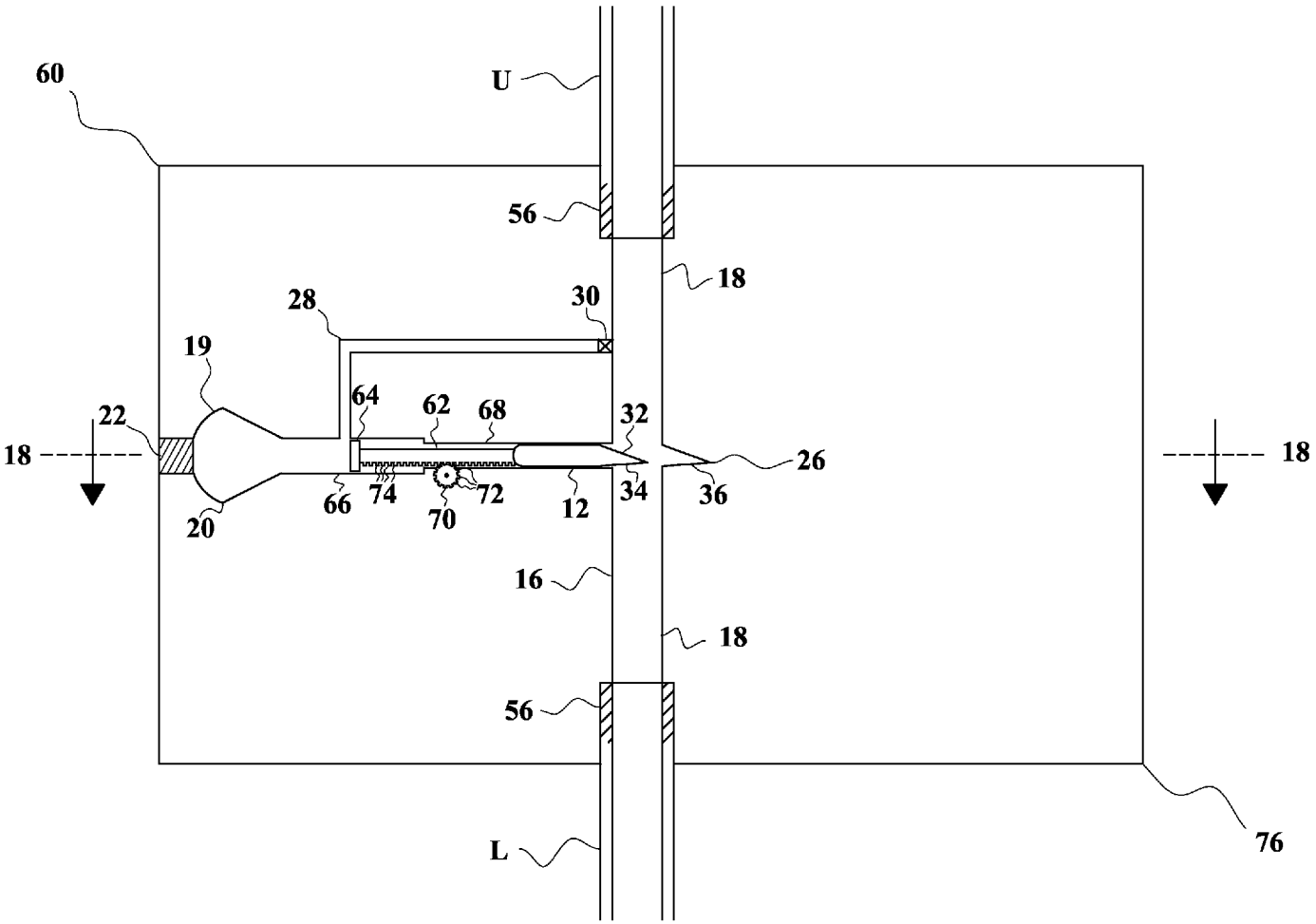
FIG. 14 is a vertical sectional view drawn along lines 14-14 of FIG. 15 of the third preferred embodiment of the invention, showing the position of the plate after it has been retracted to cover two-thirds of the channel.
Figure 15:
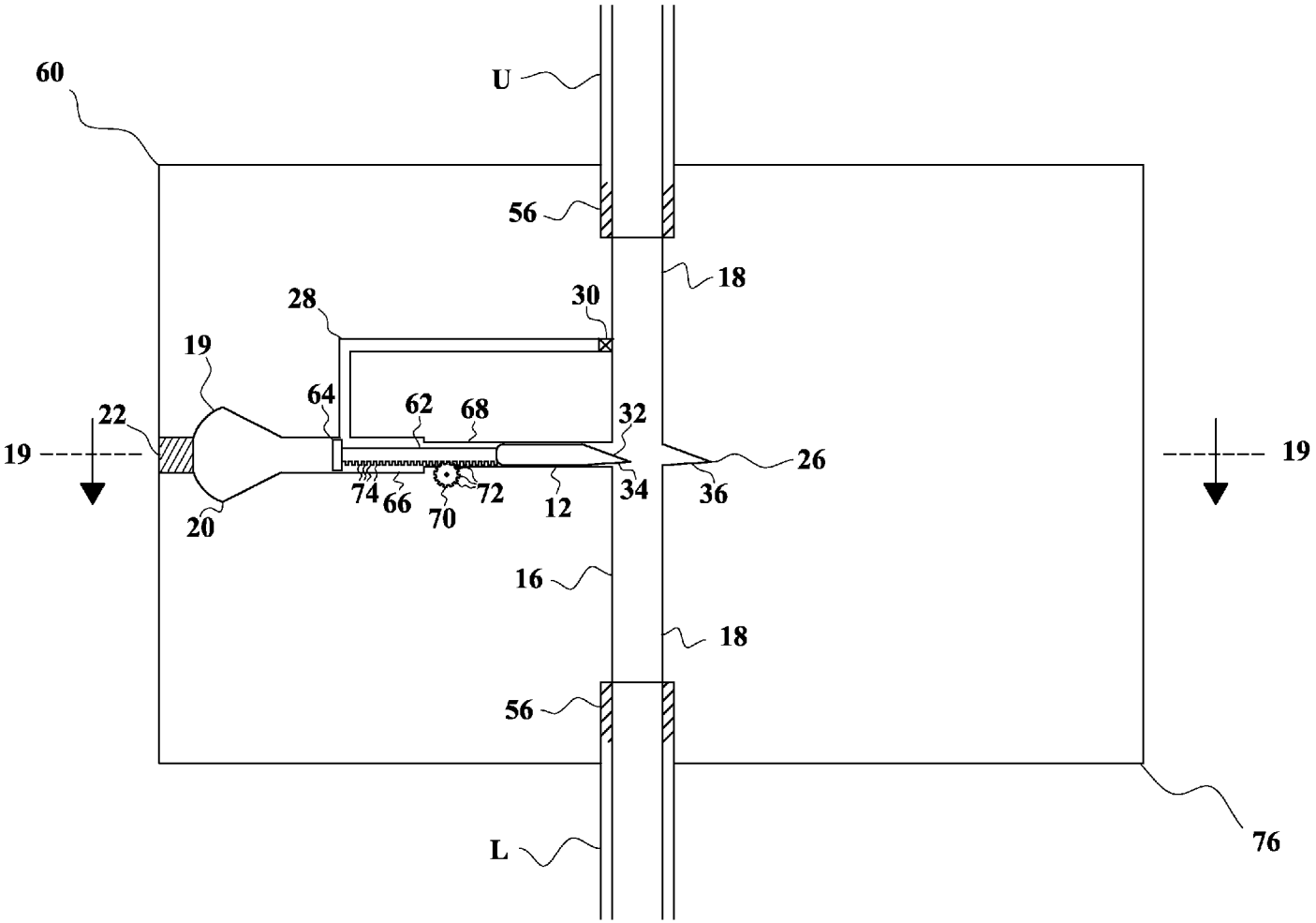
FIG. 15 is a vertical sectional view drawn along lines 15-15 of FIG. 19 of the third preferred embodiment of the invention, showing the position of the plate after it has been retracted to cover one-third of the channel.
Figure 17:
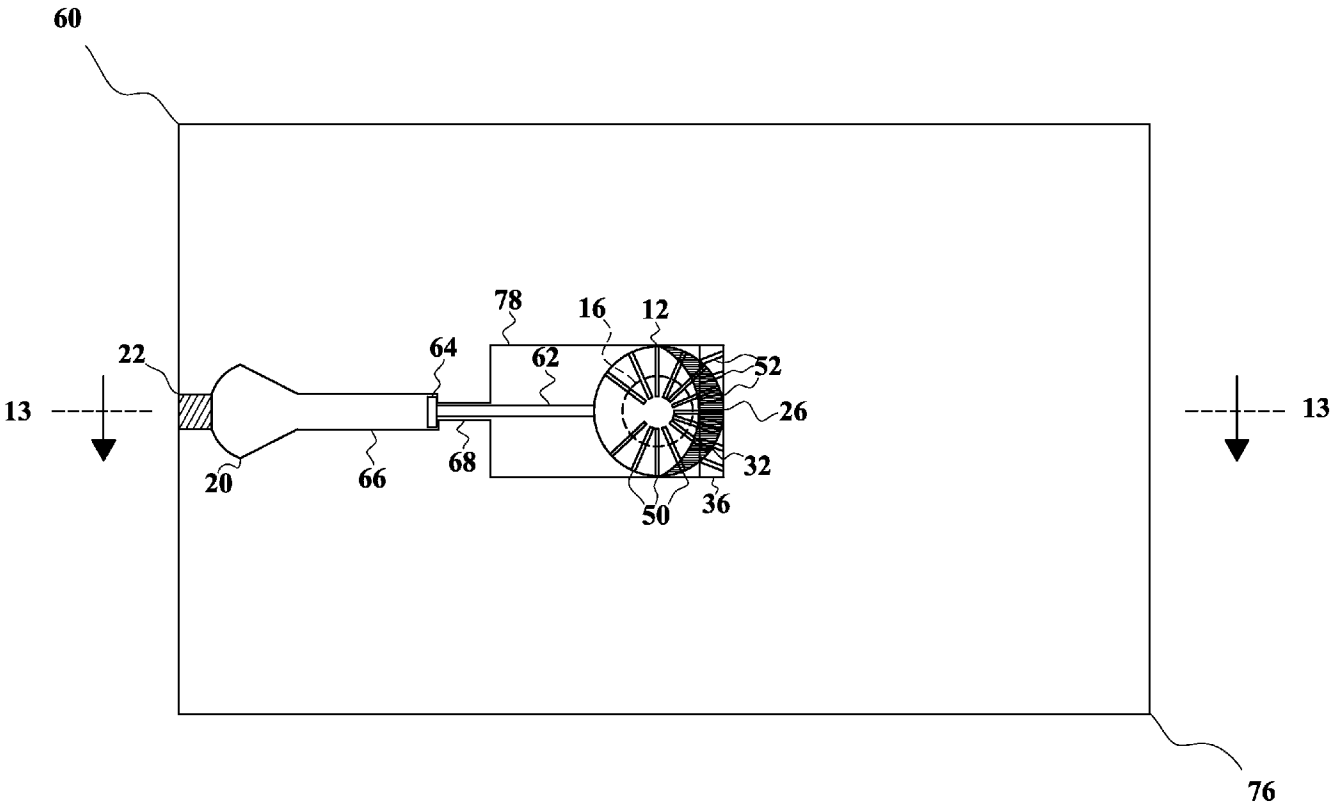
FIG. 17 is a horizontal sectional view drawn along lines 17-17 of FIG. 13 of the third preferred embodiment of the invention, showing the position of the plate after the explosive charge for the piston has been fired.

FIG. 13 is a vertical sectional view drawn along lines 13-13 of FIG. 17 of the third preferred embodiment of the invention, showing the position of the plate after the explosive charge for the piston has been fired, in which it is completely blocking the channel to prevent any fluid from passing through it. FIG. 14 is a vertical sectional view drawn along lines 14-14 of FIG. 18 of the third preferred embodiment of the invention, showing the position of the plate after it has been retracted to cover two-thirds of the channel, thus reducing and regulating the flow of oil or other fluid, but not completely blocking it. FIG. 15 is a vertical sectional view drawn along lines 15-15 of FIG. 19 of the third preferred embodiment of the invention, showing the position of the plate after it has been retracted to cover one-third of the channel, allowing greater flow, but still reducing it. The gear may be rotated by a motor or other suitable means. The gear may be lowered so as not to impede the movement of the piston and plate when the explosive charge is fired, and raised to mesh with th teeth in the piston.

Figure 18:
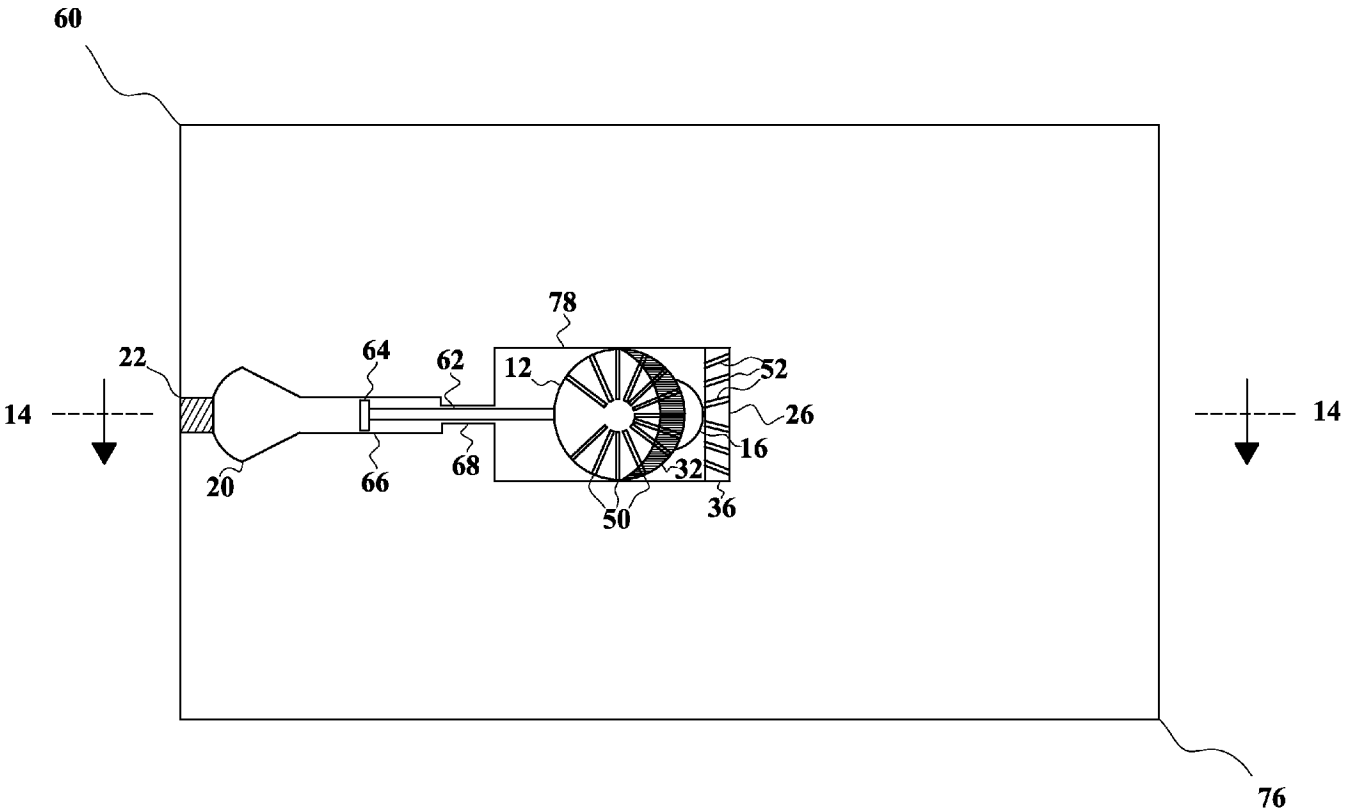
FIG. 18 is a horizontal sectional view drawn along lines 18-18 of FIG. 14 of the third preferred embodiment of the invention, showing the position of the plate after it has been retracted to cover two-thirds of the channel.
Figure 19:
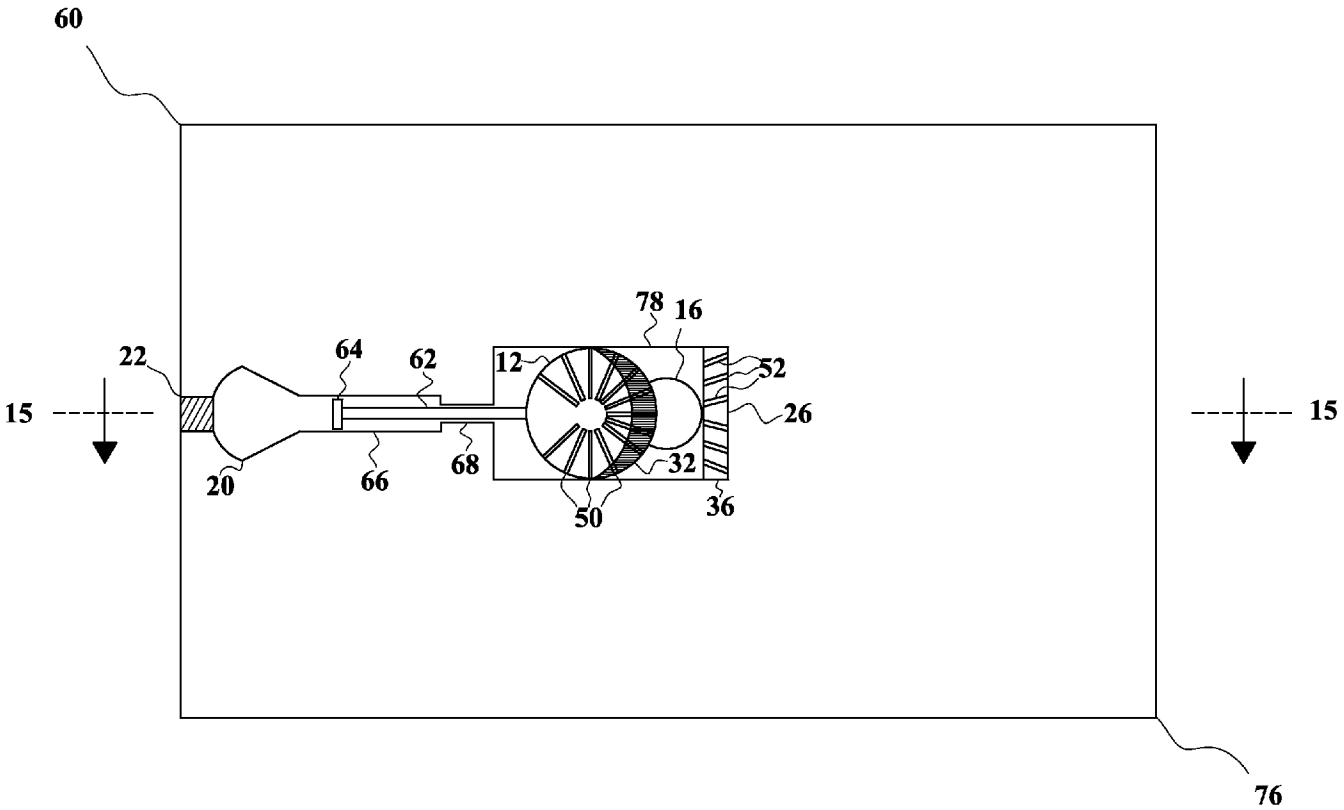
FIG. 19 is a horizontal sectional view drawn along lines 19-19 of FIG. 15 of the third preferred embodiment of the invention, showing the position of the plate after it has been retracted to cover one-third of the channel.

FIG. 16 is a horizontal sectional view drawn along lines 16-16 of FIG. 12 of the third preferred embodiment of the invention, showing the position of the plate before any explosive charge has been fired. The portion of the passage 78 in which the plate moves may be wider horizontally, even it is the same height vertically as the portion of the narrower passage 68 in which only the piston moves. As before, grooves 50 in the plate and grooves 52 in the female element allow fluid to escape so that it does not impede the movement of the plate. FIG. 17 is a horizontal sectional view drawn along lines 17-17 of FIG. 13 of the third preferred embodiment of the invention, showing the position of the plate after the explosive charge for the piston has been fired. FIG. 18 is a horizontal sectional view drawn along lines 18-18 of FIG. 14 of the third preferred embodiment of the invention, showing the position of the plate after it has been retracted to cover two-thirds of the channel. FIG. 19 is a horizontal sectional view drawn along lines 19-19 of FIG. 15 of the third preferred embodiment of the invention, showing the position of the plate after it has been retracted to cover one-third of channel.

Figure 20:
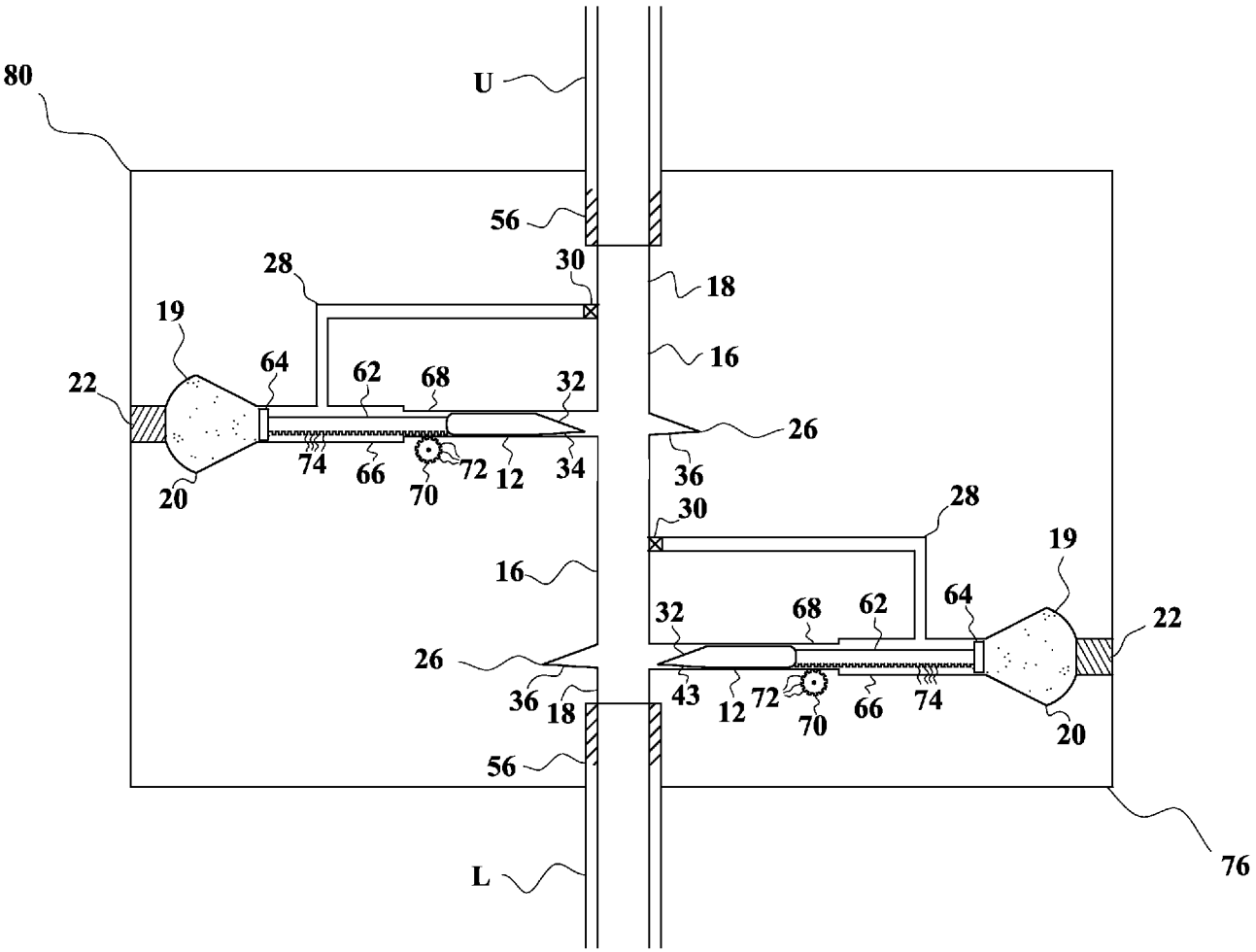
FIG. 20 is a vertical sectional view of the third preferred embodiment of the invention, showing a block with two plates.

FIG. 20 is a vertical sectional view of the third preferred embodiment of the invention, showing a block with two plates, that will enter the channel from different directions when the explosive charges are fired. Blocks may also have three or more plates. Plates may enter the channel from any number of different directions. Two or more pistons may be attached to each plate. The distance that pistons move the plates may be varied by the length of the pistons and/or the lengths of the wider and narrower portions of the passages. When there is more than one piston attached to a plate, the other pistons and their charges may serve as backups if a charge fails.

Figure 21:
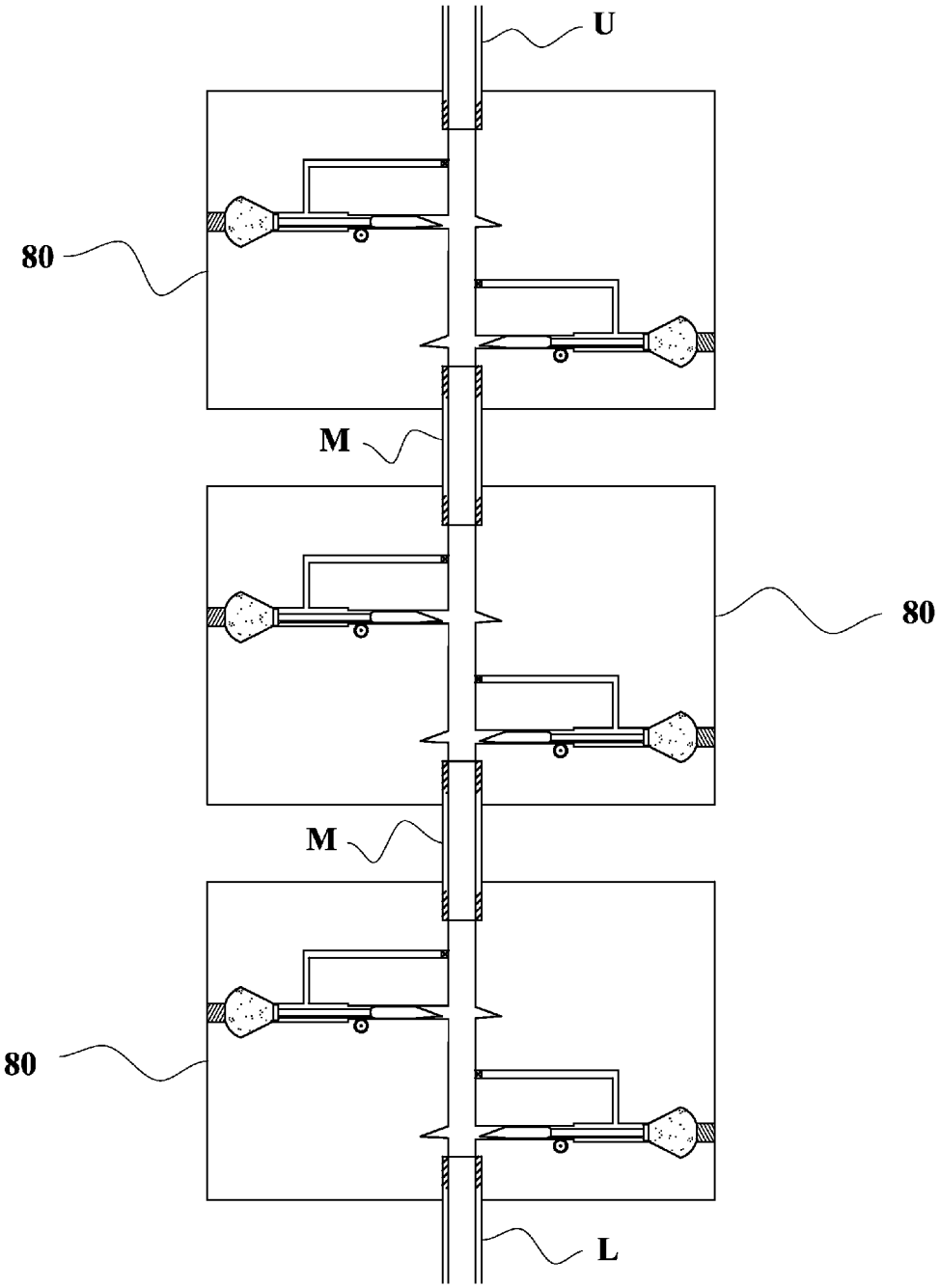
FIG. 21 is a vertical sectional view of the third preferred embodiment of the invention, showing three blocks connected by pipes.

FIG. 21 is a vertical sectional view of the third preferred embodiment of the invention, showing three blocks 80 connected to upper pipe U, middle pipes M, and lower pipe L. Any number of the blocks may be stacked in a "Christmas tree". The blocks may be directly attached without middle pipes. There may be no upper pipe. Alternatively, a well pipe may pass through the channel, in which case the plate must be capable of cutting through it.

Which plates have been activated may be indicated by displayed numbers, colors or indentations. The invention may be monitored visually on site or remotely by television, radio, wired connections, or any other suitable means. The movement of the gears and pistons may be measured and calibrated. The plates and pistons may be made of metal, high impact plastic or glass, or any other suitable material. The invention may be placed anywhere in the flow line. Multiple apparatus of the invention may be placed in series or in parallel. A black flow preventer and tunnels in the plates may be used with the third preferred embodiment, as in the first and second preferred embodiment.

The present invention also comprises a method of preventing blowouts and regulating flow, comprising the steps of:

placing one or more blocks around portions of a pipe through which fluid can flow, with each block having a channel that surrounds the pipe, and with each block having one or more plates that are initially to one side of the channel, one or more pistons attached to each plate, and an explosive charge for each piston, that when fired, can propel the plate to which the piston is attached across the channel to reduce the flow of the fluid;

retaining the blocks on the pipe; and firing one or more of the explosive charges, causing one or more of the pistons to move through passages in the blocks for each of the pistons.

The present invention may comprise further steps of moving the plates partially or completely out from (or into) the channel, using gears having teeth that can engage teeth on the pistons.

It is to be understood that the present invention is not limited to the embodiments described above, but encompasses any and all embodiments within the scope of the following claims.

I claim:

1. A blowout preventer and flow regulator, comprising:

one or more blocks, with each of the blocks having a channel, with the channel having at least one end that is dimensioned and configured so that the block can be inserted over a portion of a pipe through which fluid can flow;

one or more plates in each of the blocks, initially to one side of the channel;

one or more pistons attached to each of the plates;

an explosive charge for each of the pistons, able to be fired to propel the plate into the channel to reduce the flow of the fluid;

gears having teeth that engage teeth on the pistons to move the plates out from the channel;

a passage in the blocks for each of the pistons, the passage having a narrow portion adjacent to the channel and a wide portion away from the channel; and a flange on each piston on an end of the piston opposite the plate to which the piston is attached, that prevents said end of the piston from moving into the narrow portion of the passage, thus limiting the movement of the plate to which the piston is attached.

2. The blowout preventer and flow regulator according to claim 1, wherein:

the gears move the plates completely out from the channel.

3. The blowout preventer and flow regulator according to claim 1, wherein:

the gears move the plates partially out from the channel.

4. The blowout preventer and flow regulator according to claim 1, wherein:

the gears move the plates completely into the channel.

5. The blowout preventer and flow regulator according to claim 1, wherein:

the gears move the plates partially into the channel.

6. The blowout preventer and flow regulator according to claim 1, wherein there are a plurality of the plates, and the plates enter the channel from different directions.

7. A blowout preventer and flow regulator, comprising:

one or more blocks, with each of the blocks having a channel, with the channel having at least one end that is dimensioned and configured so that the block can be inserted over a portion of a pipe through which fluid can flow;

one or more plates in each of the blocks, initially to one side of the channel;

one or more pistons attached to each of the plates;

a means for moving each of the pistons, able to be activated to propel the plate into the channel to reduce the flow of the fluid;

gears having teeth that engage teeth on the pistons to move the plates out from the channel;

a passage in the blocks for each of the pistons, the passage having a narrow portion adjacent to the channel and a wide portion away from the channel; and a flange on each piston on an end of the piston opposite the plate to which the piston is attached, that prevents said end of the piston from moving into the narrow portion of the passage, thus limiting the movement of the plate to which the piston is attached.

8. The blowout preventer and flow regulator according to claim 7, wherein:

the gears move the plates completely out from the channel.

9. The blowout preventer and flow regulator according to claim 7, wherein:

the gears move the plates partially out from the channel.

10. The blowout preventer and flow regulator according to claim 7, wherein:

the gears move the plates into the channel.

11. The blowout preventer and flow regulator according to claim 7, wherein there are a plurality of the plates, and the plates enter the channel from different directions.

12. A method of preventing blowouts and regulating flow, comprising the steps of:

placing one or more blocks around portions of a pipe through which fluid can flow, with each block having a channel that surrounds the pipe, and with each block having one or more plates that are initially to one side of the channel, one or more pistons attached to each plate, and an explosive charge for each piston, able to be fired to propel the plate to which the piston is attached across the channel to reduce the flow of the fluid;

retaining the blocks on the pipe;

firing one or more of the explosive charges, causing one or more of the pistons to move through passages in the blocks for each of the pistons;

moving the plates, using gears having teeth that engage teeth on the pistons;

wherein the passage for the pistons has a narrow portion adjacent to the channel and a wide portion away from the channel; and wherein there is a flange on each piston on an end of the piston opposite the plate to which the piston is attached, that prevents said end of the piston from moving into the narrow portion of the passage, thus limiting the movement of the plate to which the piston is attached.

13. The method of preventing blowouts and regulating flow according to claim 12, wherein:

the plates are moved partially into the channel.

14. The method of preventing blowouts and regulating flow according to claim 12, wherein:

the plates are moved completely into the channel.

15. The method of preventing blowouts and regulating flow according to claim 12, wherein:

the plates are moved partially out from the channel.

16. The method of preventing blowouts and regulating flow according to claim 12, wherein:

the plates are moved completely out from the channel.

17. The method of preventing blowouts and regulating flow according to claim 12, wherein there are a plurality of the plates, and the plates enter the channel from different directions.

* * * * *